US007368155B2

(12) United States Patent
Larson et al.

(10) Patent No.: US 7,368,155 B2
(45) Date of Patent: May 6, 2008

(54) NON-ASPHALTIC PEEL AND STICK ROOFING PRODUCT FOR FASTER INSTALLATION

(75) Inventors: Timothy Larson, Wayne, NJ (US); Vinay Mehta, Bridgewater, NJ (US)

(73) Assignee: Building Materials InvestmentCorp., Wayne, NJ (US)

( * ) Notice: Subject to any disclaimer, the term of this patent is extended or adjusted under 35 U.S.C. 154(b) by 89 days.

(21) Appl. No.: 11/012,774

(22) Filed: Dec. 15, 2004

(65) Prior Publication Data

US 2006/0127627 A1 Jun. 15, 2006

(51) Int. Cl.

| | |
|---|---|
| ***B32B 9/00*** | (2006.01) |
| ***B32B 3/00*** | (2006.01) |
| ***B32B 3/14*** | (2006.01) |
| ***D06N 7/04*** | (2006.01) |

(52) U.S. Cl. ..... 428/40.1; 428/42.2; 428/47; 428/141; 428/147

(58) Field of Classification Search ..... 428/40.1, 428/41.8, 42.2, 47, 141, 147
See application file for complete search history.

(56) References Cited

U.S. PATENT DOCUMENTS 4,767,658 A * 8/1988 Lorenz ..... 428/192
4,910,059 A * 3/1990 Sancaktar ..... 428/47
5,849,133 A * 12/1998 Senderling et al. ..... 156/315
7,101,598 B2 9/2006 Hubbard
2003/0219564 A1* 11/2003 Hubbard ..... 428/40.1
2004/0191508 A1 9/2004 Hubbard et al.

OTHER PUBLICATIONS

POLYSTICK USA; "Polystick: The New Generation of Underlayment and Waterproofing Membranes" product literature; date unknown; 6 pages.

GAF Materials Corporation; "FreedomTPO" product literature; date unknown; 2 pages.

Oikos; "Polyglass" product literature; http://oikos.com/products/moisture/polyglass/ last printed on May 29, 2007.

POLYGLASS USA; "Seallap" product literature; http://www.polyglass.net/html/usa/products/video/seal_lap/seallap.html last printed on Nov. 18, 2004.

* cited by examiner

*Primary Examiner*—Patricia L. Nordmeyer
(74) *Attorney, Agent, or Firm*—William J. Davis; Sills Cummis & Gross PC

(57) ABSTRACT

The present invention provides a non-asphaltic peel-and-stick roofing membrane for quicker and easier installation to a roof substrate, as well as a method of manufacturing the membrane.

17 Claims, 1 Drawing Sheet

NON-ASPHALTIC PEEL AND STICK ROOFING PRODUCT FOR FASTER INSTALLATION

FIELD OF THE INVENTION

The present invention relates to roofing membranes. More specifically, the present invention relates to non-asphaltic peel-and-stick roofing membranes for quicker and easier installation.

BACKGROUND OF THE INVENTION

A single-ply building membrane is a membrane typically applied in the field using a one layer membrane material (either homogeneous or composite) rather than multiple layers built-up. These membranes have been widely used on low slope roofing and other applications. The membrane can comprise one or more layers, have a top and bottom surface, and may include a reinforcing scrim or stabilizing material. The scrim is typically of a woven, nonwoven, or knitted fabric composed of continuous or discontinuous strands of material used for reinforcing or strengthening membranes.

These single-ply membranes typically comprise base (bottom) and cap (top) polyolefin-based sheets (layers) with a fiber reinforcement scrim (middle) sandwiched between the other two layers. The scrim is generally the strongest layer in the composite. Other materials from which the membranes may be formed, include but are not limited to, polyvinyl chloride (PVC), chlorosulfonated polyethylene (CSPE or CSM), chlorinated polyethylene (CPE), and ethylene propylene diene polymer (EPDM).

Current non-asphaltic roll membranes which are self adhering, such as those based on TPO and PVC membrane, require cleaning of side laps areas. Often this is followed by a solvent-based priming step. Both the cleaning step and the priming step together significantly slow down the installation of these self-adhering products.

The side lap is the continuous longitudinal overlap of neighboring like materials. Presently, side lap preparation requires the application of cleaners or primers on to the side lap of the membrane by brushing and/or rolling. Additionally, many primers and cleaners are caustic and can irritate or burn the roofer's hands and skin.

SUMMARY OF THE INVENTION

The present invention is directed to a non-asphaltic single-ply roofing membrane in which the side lap area is factory modified such that the surface modification consists one or more of the following:

a. Application of a cleaning step, which may or may not, involve organic solvents such as toluene, heptane, xylene, methyl ethyl ketone (MEK), ethylbenzene, naphtha or other hydrocarbons, etc. or a mixture thereof. In many cases (depending on the nature of substrate), only a dry wipe cleaning (with a cloth) is satisfactory to rid the surface of dust, foreign matter and even oil stains;

b. Application of a primer consisting of any of the above-mentioned organic solvents or a mixture thereof;

c. Application of a hot adhesive over a dust-free side lap area.

With regard to the application of a hot adhesive, priming is generally unnecessary as the hot adhesive forms excellent bond with the substrate (weather side of single-ply membrane) without primer. In this case, a release liner may be necessary over such a factory-modified seam so as to prevent unintended sticking to the back side of the roll. The adhesive application in the side lap area (on the weather side) can be favorably and more preferably achieved by coating the melted adhesive by any of the common methods (such as roll coating, slot die coating, doctor blade coating, etc.) well known to those practicing the art.

Any one or more of these steps are accomplished at the factory during the manufacture of finished roll products. A combination of steps (a) and (b) or steps (a) and (c) above allows elimination of the following during installation over the roof:

(1) cleaning and/or priming the seam;

(2) applying an adhesive tape or spraying an adhesive with the intention to form a side-lap The membrane according to the present invention comprises a single-ply membrane having a lower surface and an upper surface, the upper surface having side lap area defined at diametrically opposite borders of the membrane, a primer and/or cleaner applied on the side lap area, an adhesive coated on the primer and/or cleaner applied on the side lap area; and a removable release liner applied on the adhesive.

The preparation of the membrane in accordance with the present invention comprises the steps of pre-cleaning/pre-priming the side lap of a single-ply membrane having an adhesive layer and release liner on its deck side, coating the side lap with an adhesive material, applying a release liner on the adhesive material, and rolling the membrane for storage and later application on a roof substrate.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE FIGURE

These and other features, aspects, and advantages of the apparatus and methods of the present invention will become better understood with regard to the following description, appended claims, and accompanying drawings where:

DETAILED DESCRIPTION

Although this invention is applicable to numerous and various roofing structures, it has been found particularly useful in the environment of single-ply roofing membranes. Therefore, without limiting the applicability of the invention to single-ply roofing membranes, the invention will be described in such environment.

As used herein, the term "roofing membrane" generally refers to refers to the conventional meaning of the term roofing membrane, i.e. a water impermeable sheet of polymeric material that is secured to a roof deck. A roofing membrane may use polymeric materials such as ethylene propylene diene polymer rubber (EPDM), chlorinated polyethylene, PVC, chlorosulfonated polyethylene, thermoplastic polyolefin (TPO), etc. The roofing membrane may be made from a blended composite polymer having additives, such as UV screeners, UV absorbers or stabilizers, fire retardants, etc. to improve weatherability.

Figure 1:
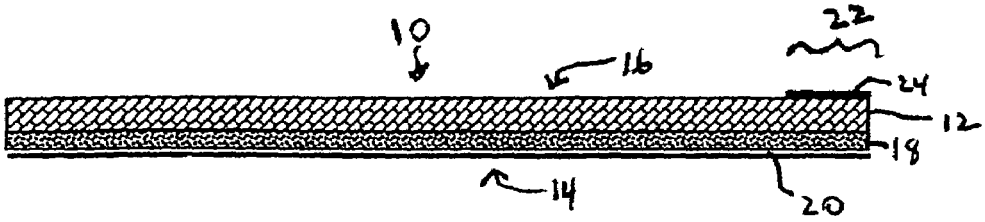
FIG. 1 is a schematic side view of one embodiment of the membrane in accordance with the present invention.

FIG. 1 is a schematic representation of the layers of the non-asphaltic membrane in accordance with one embodiment of the present invention. In FIG. 1, sheet 10 includes a substrate or membrane 12, which may be TPO or PVC, but is not limited thereto. Membrane 12 has a deck side 14, which is the side of membrane 12 that is applied on a roof substrate (not shown). The opposite side of membrane 12 is referred to as the weather side 16, which is the side that exposed to the environment when deck side 14 of membrane 12 is applied to a roof substrate. A first adhesive layer 18 is coated on deck side 14 of membrane 12. A release liner 20 is then placed upon first adhesive layer 18. When sheet 10 is to be applied to a roof substrate, release liner 20 is peeled off first adhesive layer 18. Sheet 10 is then positioned on the roof substrate and is adhered thereto by first adhesive layer 18. This type of sheet is thus commonly referred to as a "peel and stick" membrane.

The border/edge of membrane 12 is commonly earmarked as the side lap area 22. Side lap 22 extends lengthwise along the entirety of membrane 12. Depending upon the type of membrane, side lap 22 generally has a width in the range of approximately 1 inch to 20 inches. More preferably, the width of side lap 22 is in the range of approximately 3 to 6 inches. As explained hereinabove, side lap 22 is a generally a continuous longitudinal overlap of neighboring like materials, i.e. sheets 10. In accordance with the present invention, side lap 22 is cleaned and/or primed with commonly used roofing cleaners and/or primers. The cleaners and/or primers are coated directly on side lap 22 on weather side 16 of membrane 12. A second layer of adhesive 24, which may be the same or different from first adhesive layer 18, is then coated on the pre-cleaned/pre-primed side lap 22. A release liner 26 is preferably applied upon second adhesive layer 24 coated on side lap 22. Depending upon the cleaner/primer applied on side lap 22, liner 26 may be optional. For example, certain adhesives are heat-activated or pressure sensitive. Such adhesives may not be immediately tacky and thus there is no need for a liner.

Adhesive layer on 24 that is applied on side lap 22 of weather side 16 of membrane 12 allows for overlapping one roll over another lengthwise when applied on a roof substrate.

Figure 2:
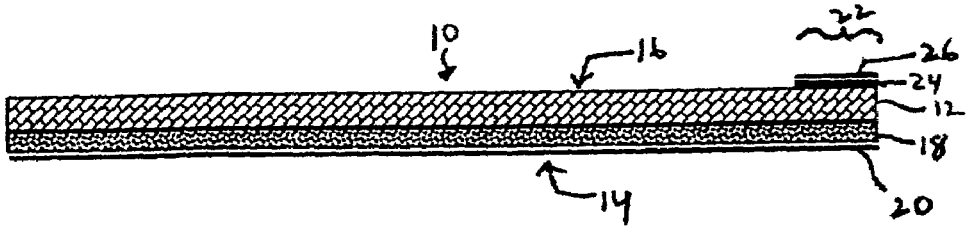
FIG. 2 is a schematic side view of a second embodiment of the membrane in accordance with the present invention.

In another embodiment illustrated in FIG. 2, sheet 10 is provided as described immediately above, and wherein side lap 22 having cleaner and/or primer thereon (indicated by 24) has 10-90% of thickness of first adhesive layer 18.

Figure 3:
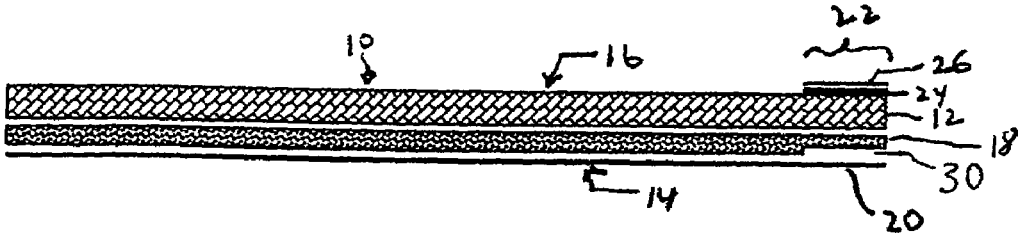
FIG. 3 is a schematic side view of a third embodiment of the membrane in accordance with the present invention.

In another embodiment as illustrated in FIG. 3, sheet 10 is provided as discussed immediately above in the second embodiment. In this embodiment, however, first adhesive layer 18 in the area corresponding to side lap 22 on deck side 14 of membrane 12 is reduced more than, less than or equal to the thickness of second adhesive layer 24 applied on side lap 22 on weather side 16 of membrane 12. The reduced area is indicated at 30.

In all of the embodiments in accordance with the present invention, membrane 12 is preferably a thermoplastic single-ply membrane but is not limited in this regard. Membrane 12 may be modified bitumen or thermoset or thermoplastic membrane preferably polyvinyl chloride (PVC) and other resinous compositions containing polyvinyl chloride, chlorosulfonated polyethylene (CSPE or CSM), chlorinated polyethylene (CPE), ethylene propylene diene polymer (EPDM), APP modified bitumen, SBS modified bitumen, or a thermoplastic olefin (TPO).

In accordance with the present invention, the side lap area is factory modified such that the surface modification consists one or more of the following:

a. Application of a cleaning step, which may or may not, involve organic solvents such as toluene, heptane, xylene, methyl ethyl ketone (MEK), ethylbenzene, naphtha or other hydrocarbons, etc. or a mixture thereof. In many cases (depending on the nature of substrate), only a dry wipe cleaning (with a cloth) is satisfactory to rid the surface of dust, foreign matter and even oil stains;
b. Application of a primer consisting of any of the above-mentioned organic solvents or a mixture thereof;
c. Application of a hot adhesive over a dust-free side lap area.

With regard to the application of a hot adhesive, priming is generally unnecessary as the hot adhesive forms excellent bond with the substrate (weather side of single-ply membrane) without primer. In this case, a release liner may be necessary over such a factory-modified seam so as to prevent unintended sticking to the back side of the roll. The adhesive application in the side lap area (on the weather side) can be favorably achieved by coating the melted adhesive by any of the application methods commonly used in applying roofing materials, such as roll coating, slot die coating, doctor blade coating, etc.

Any one or more of the above-mentioned steps are accomplished at the factory during the manufacture of finished roll products.

In preparing sheet 10 at a factory in accordance with the described embodiments, a long strip of membrane 12 is extended along a surface. A side lap area 22 is defined on weather side 16 of membrane 12. Side lap 22 is then cleaned and pre-primed. Second adhesive layer 24 is then coated upon the cleaned and pre-primed side lap 22. Release liner 26 is then placed on second adhesive layer 24. Sheet 10 is then rolled for storage and later application on a roof substrate.

First and second adhesive layers 18 and 24 may be any adhesive or glue commonly used in the roofing industry for applying membranes to a roof substrate. Nonlimiting examples of adhesives include, but are not limited to, polyurethane, ethylene-butylene-styrene, and other known deal load shear capable adhesives such as Adco PSA-3™, manufactured by Adco Products, Inc. Other common pressure sensitive adhesives are butyl rubber based (containing polyisobutene and/or polyisoprene or polybutenes) or styrene-butadiene-styrene (SBS), styrene-ethylene-butadiene-styrene (SEBS), styrene-isoprene-styrene (SIS), acrylics, etc.

First and second adhesive layers 18, 24, in accordance with the present invention, has excellent tack and quick stick properties. The adhesive resists extreme heat and cold. Additionally, the adhesive may be used with a roofing article such as EPDM rubber or TPO to provide a watertight seal. The adhesive may be used in a variety of weather conditions, and no special equipment is required. Additionally, the adhesive poses no environmental hazard and does not require hazardous solvents.

The primers and/or cleaners which may be applied on side lap 22 include, but are not limited to, Heptanes, Toluene, Methyl Alcohol, Hexane, Xylene, Methyl ethyl ketone (MEK), Diphenylmethane Diisocyanate, Polymethylene Polyphenol Isocyanate, Ethylbenzene, Naphtha, Hydrocarbon Resins and Halogenated Butyl or a suitable mixture thereof. These liquids can be used individually or in various mixtures with each other or with additional ingredients.

Release liners 20 and 26 may be any suitable release liner material such as waxed paper, polycoated paper, film based paper or a plastic commonly associated with silicon chemistry. Release liners 20, 26 facilitate acceptable package, storage, and installation performance. The release system exhibits little or no affinity for the adhesive and exhibits no negative impact on the initial tackiness of the adhesive, and on the subsequent utility of the adhesive in application and long term performance. In addition, the release system permits ready manual separation of the shingles or tiles at ordinary ambient temperatures. Practically, release liners 20, 26 include, for example, sheet materials including various films (i.e., cellophane, polyester, polypropylene, polyethylene, polyvinylalcohol and polyvinylchloride), paper, foil and the like which have been subjected to surface-treatment such as coating and/or impregnating with synthetic resins having high release properties (e.g., silicone resins and fluorocarbons). Release liners 20, 26 may optionally be treated with a release agent such as silicone resin and fluorine containing resins).

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A self-adhering peel-and-stick roofing membrane comprising:

a. a thermoplastic single-ply membrane having a lower surface and an upper surface, the lower surface having a first pressure sensitive adhesive layer coated thereon and a first removable release liner on the first pressure sensitive adhesive layer, the upper surface having a side lap area defined at one lengthwise border of the membrane and extending longitudinally thereon;

b. optionally a primer and/or cleaner layer applied on the side lap area;

c. a second pressure sensitive adhesive layer coated on the side lap area or on the optional primer and/or cleaner applied on the side lap area;

d. a removable release liner applied on the second pressure sensitive adhesive layer;

e. a reduced area, the reduced area being located on the first pressure sensitive adhesive layer on the lower surface of the membrane, the reduced area corresponding to the second pressure sensitive coated on the side lap area on the upper surface of the membrane, in which the reduced area is reduced or equal to the thickness of the second pressure sensitive adhesive layer coated on the side lap area.

2. The membrane as recited in claim 1, wherein the first adhesive layer on the lower surface of the membrane in the reduced area corresponding to the side lap area on the upper surface of the membrane is reduced more than the thickness of second adhesive layer on the side lap on the upper surface of the membrane.

3. The membrane as recited in claim 1, wherein the first adhesive layer on the lower surface of the membrane in the reduced area corresponding to the side lap area on the upper surface of the membrane is reduced less than the thickness of the second adhesive layer on the side lap on the upper surface of the membrane.

4. The membrane as recited in claim 1, wherein the width of the side lap is in the range of from approximately 1 inch to 20 inches.

5. The membrane as recited in claim 4, wherein the width of the side lap is in the range of from approximately 3 inches to 6 inches.

6. The membrane as recited in claim 1, wherein the single-ply membrane is selected from the group consisting of: modified bitumen or thermoset or thermoplastic membrane preferably polyvinyl chloride (PVC) and other resinous compositions containing polyvinyl chloride, chlorosulfonated polyethylene (CSPE or CSM), chlorinated polyethylene (CPE), ethylene propylene diene terpolymer (EPDM), APP modified bitumen, SBS modified bitumen, or a thermoplastic olefin (TPO).

7. The membrane as recited in claim 1, wherein the primer and/or cleaner is selected from the group consisting of heptanes, toluene, methyl alcohol, hexane, xylene, diphenylmethane diisocyanate, polymethylene polyphenol isocyanate, ethylbenzene, naphtha, hydrocarbon resins or halogenated butyl or a suitable mixture thereof, wherein the mixture has a flash point between 40 and 250° F.

8. The membrane as recited in claim 1, wherein the adhesive material in first and second pressure sensitive adhesive layers are selected from the group consisting of polyisobutenes (PIB), polybutenes, polyisoprene, butyl rubber, styrene-isoprene-styrene (SIS), styrene-butadiene-styrene (SBS), styrene-ethylene-butadiene-styrene (SEBS), acrylics, polyurethanes, atactic polypropylene (APP) or a suitable mixture thereof.

9. The membrane as recited in claim 1, wherein the release liner is selected from the group consisting of waxed paper, polycoated paper, film-based paper or plastic.

10. A method of preparing a self-adhering peel-and-stick roofing membrane, the method comprising the steps of:

a. providing a length of a thermoplastic single-ply membrane having a lower surface and an upper surface, the lower surface having a first pressure sensitive adhesive layer coated thereon and a release liner on the first pressure sensitive adhesive layer, the upper surface having a side lap area defined at one lengthwise border of the membrane and extending longitudinally thereon;

b. optionally pre-priming and pre-cleaning the side lap of a single-ply membrane;

c. coating the side lap area or the optionally pre-primed and pre-cleaned side lap area with a second pressure sensitive adhesive layer having a thickness that is 10% to 90% of the thickness of the first adhesive layer;

d. applying a release liner on the second adhesive layer;

e. providing the first pressure sensitive adhesive layer with a reduced area portion, the reduced area portion corresponding to the second pressure sensitive adhesive layer of the side lap area, the reduced area portion being reduced or equal to the thickness of the second pressure sensitive adhesive layer; and f. rolling the membrane for storage and later application on a roof substrate.

11. The method as recited in claim 10, wherein the adhesive material in the second pressure sensitive adhesive layer may be the same or a compatible adhesive as the first pressure sensitive adhesive layer.

12. The method as recited in claim 10, wherein the release liner is selected from the group consisting of waxed paper, polycoated paper, film-based paper or plastic.

13. The method as recited in claim 10, wherein the width of the side lap is in the range of from approximately 1 inch to 20 inches.

14. The method as recited in claim 13, wherein the width of the side lap is in the range of from approximately 3 inches to 6 inches.

15. The method as recited in claim 10, wherein the single-ply membrane is selected from the group consisting of: modified bitumen or thermoset or thermoplastic membrane preferably polyvinyl chloride (PVC) and other resinous compositions containing polyvinyl chloride, chlorosulfonated polyethylene (CSPE or CSM), chlorinated polyethylene (CPE), ethylene propylene diene terpolymer (EPDM), APP modified bitumen, SBS modified bitumen, or a thermoplastic olefin (TPO).

16. The method as recited in claim 10, wherein the primer and/or cleaner is selected from the group consisting of heptanes, toluene, methyl alcohol, hexane, xylene, diphenylmethane diisocyanate, polymethylene polyphenol isocyanate, ethylbenzene, naphtha, hydrocarbon resins or halogenated butyl or a suitable mixture thereof.

17. The method as recited in claim 10, wherein the adhesive material in first and second pressure sensitive adhesive layers are selected from the group consisting of polyisobutenes (PIB), polybutenes, polyisoprene, butyl rubber, styrene-isoprene-styrene (SIS), styrene-butadiene-styrene (SBS), styrene-ethylene-butadiene-styrene (SEBS), acrylics, polyurethanes, atactic polypropylene (APP) or a suitable mixture thereof.

* * * * *